United States Patent [19]

Uchida et al.

[11] 4,248,676

[45] Feb. 3, 1981

[54] METHOD FOR TREATING STEEL PLATE AND ITS MANUFACTURE

[75] Inventors: Hiromu Uchida; Osamu Yanabu, both of Himeji, Japan

[73] Assignee: Nippon Steel Corporation, Tokyo, Japan

[21] Appl. No.: 928,792

[22] Filed: Jul. 28, 1978

Related U.S. Application Data

[60] Continuation of Ser. No. 858,333, Dec. 7, 1977, which is a continuation of Ser. No. 627,741, Oct. 31, 9175, abandoned, which is a continuation of Ser. No. 430,417, Jan. 3, 1974, abandoned, which is a division of Ser. No. 109,938, Jan. 26, 1971, Pat. No. 3,827,866, which is a continuation of Ser. No. 625,421, Mar. 23, 1967, abandoned.

[30] Foreign Application Priority Data

Mar. 26, 1966 [JP] Japan ..... 41/18522
Nov. 11, 1966 [JP] Japan ..... 41-74147

[51] Int. Cl.[3] ..... C25D 3/04; C25D 11/38
[52] U.S. Cl. ..... 204/56 R; 204/38 R; 204/38 E; 204/41
[58] Field of Search ..... 204/41, 38 R, 38 E, 204/56 R

[56] References Cited

U.S. PATENT DOCUMENTS

| | | | |
|---|---|---|---|
| 2,746,915 | 5/1956 | Giesker et al. | 204/56 R |
| 3,113,845 | 12/1963 | Uchida et al. | 204/38 E |
| 3,526,486 | 9/1970 | Smith et al. | 204/41 |

*Primary Examiner*—R. L. Andrews
*Attorney, Agent, or Firm*—Toren, McGeady and Stanger

[57] ABSTRACT

This invention relates to the surface treatment of steel plates or sheets and discloses a novel steel sheet structure, wherein the steel sheet is first electrolytically surface coated with a metallic chromium layer of a thickness not exceeding about 0.1 micron and is then electrolytically plated with a chromate film of a thickness not exceeding 0.1 mg/dm$^2$. The chromium layer thickness should preferably not be less than 0.0016 micron. The inventive steel sheet constitutes a superior can stock and may be provided with a top coat of organic composition.

The invention also discloses a two-step process for producing the sheet. Pursuant to this process the metallic chromium layer is first electrolytically deposited on the steel sheet surface, whereupon the chromate film is electrolytically deposited on the metallic chromium layer. An important feature of the invention is that the chromate treatment is carried out in a solution which is devoid of a sulphuric acid radical having a tendency to deposit metallic chromium. Particular process conditions in respect to bath composition, current density and treatment time are disclosed.

1 Claim, 2 Drawing Figures

METHOD FOR TREATING STEEL PLATE AND ITS MANUFACTURE

CROSS-REFERENCE TO RELATED APPLICATIONS

This is a continuation of application Ser. No. 858,333, filed on Dec. 7, 1977, which, in turn, was a continuation of application Ser. No. 627,741, filed on Oct. 31, 1975, now abandoned, which, in turn, was a continuation of application Ser. No. 430,417, filed on Jan. 3, 1974, now abandoned, which, in turn, was a divisional application of Ser. No. 109,938, filed on Jan. 26, 1971, now U.S. Pat. No. 3,827,866, which, in turn, was a continuation of application Ser. No. 625,421, filed on Mar. 23, 1967, now abandoned.

SUMMARY OF THE INVENTION

This invention generally relates to the surface coating of steel and is particularly directed to novel surface-treated steel plates or sheets in which a metallic chromium layer is directly plated on the steel sheet surface, a chromate layer thereupon being electrolytically superimposed on the metallic chromium layer. The invention is also concerned with a procedure for obtaining the novel surface coated steel sheets and encompasses the subsequent coating of the surface-treated steel sheets with organic coating compositions.

Relatively thin-gauge steel sheets imparted with the inventive chromium-chromate layers have proved to be superior can stock.

Various proposals have been put forward in the art for the purpose of chromate-treating steel plates, to wit, directly coating the steel sheet surface with a chromate film. According to one prior art procedure, the steel plate to be chromate coated is subjected to cathodic treatment in an aqueous solution containing hexavalent chromium ions and trivalent chromium ions.

According to another suggestion, the cathodic treatment of the steel plate is effected in an aqueous solution containing chromic acid anhydride, trivalent chromium ions, phosphoric acid and boric acid. It has also been proposed that the cathodic treatment of the steel plate can be effected in a liquid system prepared by adding chromic acid ions to a phosphoric acid solution, the solution also comprising acidic phosphates of zinc, magnesium, calcium and manganese. In a more recent method, the steel plate is subjected to treatment in an aqueous solution of chromic acid, the solution also containing certain reducing materials which have a tendency to reduce the chromic acid to form a film of reduced chromic acid on the steel plate. The thus treated steel plate is then heated to about 250° F. It has also recently been suggested to effect the cathodic treatment of the steel plate in a liquid containing phosphoric acid and dichromate.

U.S. Pat. No. 2,769,774 teaches still another procedure, according to which the cathodic treatment is performed in a bath prepared by adding phosphoric acid to a chromic acid anhydride solution. Similar processes have been taught in U.S. Pat. Nos. 2,733,199 and 2,780,592, according to which the cathodic treatment is performed in an aqueous bath liquid containing boric acid or its salts and chromic acid anhydride in aqueous solution.

Finally, U.S. Pat. Nos. 2,768,103, 2,768,104 and 2,777,785 suggest a procedure in which the steel plate is immersed in a liquid prepared by adding a reducing agent such as, for example, cane sugar, to an aqueous solution of chromic acid anhydride, whereupon the plate is dried under the formation of a chromate film. It has also been suggested that the cathodic treatment be performed in a chromic acid containing bath enriched by certain compounds that have a tendency to accelerate the film formation such as, for example, cathecholdisulfonic acid, phenol disulfonic acid and the like compounds. Other film inducing agents have been suggested for this purpose as, for example, selenic acid, zirconic acid, potassium fluoride, sodium-silico fluoride, titanium potassium fluoride, perchloric acid and ammonium molybdate.

It should be appreciated that in all the prior art procedures referred to, the chromate film or layer is directly formed on the steel surface. This layer or film of the prior art procedures is mainly composed of chromium oxide and chromium hydrates, in which trivalent chromium is the prevailing constituent together with hexavalent chromium salts. Although the chemical structure of these surface layers has not been exactly identified, due to the amorphism of the structure, it is generally accepted by those skilled in this art that trivalent chromium oxide and its hydrates forms a film which adheres to the steel plate surface in an irregular gel state or formation, this film being covered by hexavalent chromium salts. In this manner, the steel surface is imparted with corrosion resistance due to the passivation of the structure.

A variety of modifications have lately been proposed for the purpose of improving the surface coating characteristics. According to these modifications, the proportions of the trivalent and hexavalent chromium are changed with or without the presence of a phosphate film or layer. In any event, the main components of the surface films formed on the steel plate surface are of the indicated nature and are generally referred to in the art as "chromate films". In this connection it should be appreciated that the term "chromate" as used in the field of metal surface treatment has a particular meaning and generally refers to trivalent chromium oxide and its hydrates, the trivalent chromium oxide sometimes being admixed with hexavalent chromium oxide and its hydrates.

As previously set forth, the prior art procedures result in the formation of a chromate film directly on the surface of the steel plate, and no metallic chromium layer is interposed between the steel surface and the chromate film. This is due to the composition of the bath or treating liquid and the prevailing cathodic treatment conditions under which the electrolytic treatment takes place.

Generally, the prior art procedures referred to may be classified into two groups: According to the first group, the steel plate is contacted with an aqueous liquid predominantly comprising hexavalent chromic acid or dichromate to which a reducing agent or an agent accelerating the film formation has been added. The steel plate may be contacted with the liquid either by dipping, or by spraying the liquid onto the steel surface.

According to the second group, the steel plate is subjected to cathodic treatment in which the electroplating is performed in a liquid of similar composition with the steel plate constituting the cathode.

It is well known by those skilled in the art that, although the direct formation of a chromate film on the steel plate surface improves the corrosion resistance of the steel, the chromate film is not fully satisfactory or adequate for a variety of purposes to which the steel plate may be put. Thus, for example, the corrosion resistance of chromate treated steel plates is generally satisfactory as long as the plate remains uncoated with organic coatings, but once an organic coating has been applied onto the chromate layer and the plates have been formed, the chemical resistance of the resulting product is unsatisfactory as evidenced by chemical resistance tests. In this connection it should be appreciated that if the chromate treated steel plates are to be used, for example, for the manufacture of cans, an additional top coating with organic compositions is necessary and indeed required by the laws of most countries. The reason that the characteristics of chromate treated steel plates to which an organic coating has been applied are unsatisfactory, is due to the fact that, although relatively good adherence is obtained between the organic coating composition and the chromate film, the adherence between the steel surface and the chromate film is unsatisfactory. It has thus been found that when a chromate treated steel plate, subsequently coated with an organic lacquer or varnish composition, is immersed in a solution containing citric acid and sulphuric acid, the acidic solution penetrates through the organic coating film to corrode the chromate film and the steel surface progressively, until the organic film peels off.

U.S. Pat. No. 3,113,845 is concerned with surface coated steel sheets for can stock purposes, wherein the steel sheet is electrolytically coated with a metallic chromium layer of predetermined thickness, the chromium layer in turn being coated with an organic coating composition. This patent constitutes an important improvement in the art of surface treating steel plates and teaches the production of steel plates which are superior to those coated with a chromate film. The U.S. patent referred to contains specific disclosures concerning the thickness of the metallic chromium layer, the maximum thickness of the layer being indicated as 0.1 micron. This maximum thickness of the chromium layer is important from the viewpoint of quality. In respect to the lower limit of the chromium layer thickness, consideration has been given to the minimum thickness necessary to obtain sufficient corrosion resistance, which latter should be equal if not superior to that of ordinary tin plates used as can stock. Chromium plated can stock of the nature disclosed in U.S. Pat. No. 3,113,845 and having a chromium layer thickness of from 0.005–0.1 micron has been favorably received by the trade and the industry and is now widely accepted as superior and low-priced can stock material. It has also found other commercial applications.

It is a primary object of the present invention still further to improve on the qualities and characteristics of steel plates which have been directly chromium plated such as disclosed in U.S. Pat. No. 3,113,845.

According to the U.S. patent referred to, the steel plate, after the metallic chromium layer has been electrolytically deposited thereon, may be chemically treated with a diluted chromic acid solution. This treatment, according to the prior patent, is effected in a tank into which the chromium plated steel plate is dipped. Extensive experiments have indicated that this dipping treatment does not yield significantly improved results and, inspite of the dipping into chromic acid solution, the final plate is susceptible to pit corrosion before the organic coating has been applied, when the plate is subjected to salt spray testing. Further, it has been ascertained that the plates do not exhibit improved corrosion resistance even after the organic coating is applied subsequent to the chromic acid dipping treatment. It has thus been established that if the final products manufactured from the plates and after they have been top-coated with the organic composition, are subjected to corrosion tests, no improved results are obtained. This is particularly so if the chromium layer thickness is less than 0.01 micron. With layer thicknesses in the range of 0.01–0.1 micron better results could be observed. Investigations have revealed that when a chromium plated steel plate is dipped into a chromic acid solution, as taught in the prior patent, a chromate film is merely formed at the pin hole areas of the steel plate, but no chromate film formation can be observed on the metallic chromium layer. In other words, only at the exposed areas where no chromium layer is formed on the steel surface, does a chromate film adhere to the steel proper, thus covering the pin holes.

Our studies were then directed towards finding efficient treatment conditions for forming a chromate film on the metallic chromium layer by means of cathodic treatment and as a result of such studies, an efficient and simple method was developed electrolytically to deposit a chromate film on the metallic chromium layer previously electroplated onto the steel surface. In accordance with this procedure which thus forms a primary aspect of the present invention, the pin hole portions are also covered by a chromate film (chromium oxide and/or chromium hydrate film) so that the chromate layer uniformly covers the entire top surface of the steel plate and overlies both the metallic chromium film on the sheet and the pin hole areas. It was further established that subsequent coating of the chromate layer with organic compositions results in a superior product and that such product has excellent corrosion resistance and adherence characteristics of the various layers. The chromate film formed in accordance with this invention has, moreover, desirable density characteristics.

Steel sheets first imparted electrolytically with a metallic chromium layer and then with an electrolytically deposited chromate layer exhibit excellent results in salt spray tests before the sheets are top-coated with organic compositions. Further, the products show improved corrosion resistance, both with and without organic top coats, if the chromium layer thickness is between 0.01–0.1 micron. Moreover, the corrosion resistance of the inventive product is at least equal, if not better, than that of tin plates even if the thickness of the metallic chromium layer is as thin as 0.001 micron. From a practical point of view it has been established that the preferred thickness range for the metallic chromium layer is 0.0016–0.1 micron.

Accordingly, the present invention provides for chromium plated steel sheets which have electrolytically superimposed thereon chromate films which in turn may be covered with organic coatings. The inventive sheets have superior surface properties and are economically produced in a simple manner. Since the thickness of the various layers is extremely thin and the price of chromium is less than that of tin, the inventive sheets can be more economically produced than tin plates.

Briefly, therefore, the invention essentially resides in the provision of a surface treated steel plate having directly surface plated thereon a metallic chromium layer of a thickness of between about 0.0016–0.1 micron, the chromium layer, in turn, being electrolytically coated with a chromate film which overlies both the chromium layer and the pin hole portions.

In accordance with this invention it has been ascertained that the thickness of the chromate film superimposed onto the metallic chromium layer should not exceed 0.1 mg/dm$^2$. The chromium-chromate plated steel sheet may thereafter be top coated with an organic composition as is known in the art and as disclosed, for example, in U.S. Pat. No. 3,113,845, previously referred to.

As stated, the thickness of the chromate film electrolytically superimposed onto the chromium layer should not exceed 0.1 mg/dm$^2$. The reason for limiting the thickness of the chromate layer to the indicated upper value is primarily due to the fact that with thicker chromate films, the surface color tone of products made from the surface treated sheets does not attain any significant metallic lustre or gloss. If the chromate layer is thicker, the surface color or hue has a tendency to be of a grayish or bluish tint, thus lowering the commercial value of the product. Furthermore, thicker chromate films may result in the ultimate peeling off of the organic coating which is normally applied as top coat. This has been established in undercut film corrosion tests. Generally, the adherence characteristics suffer if the chromate layer exceeds the indicated limit and, moreover, discoloration may take place during heating of the product in an air atmosphere. This is demonstrated by the results of tests as tabulated in the following Table 1.

TABLE 1

| Thickness of chromium plating (micron) | Thickness of chromatic film (micron) | Surface color of product | Undercut film corrosion test | Discoloration during heating in air (300° C. 5 min) |
|---|---|---|---|---|
| 0.025 | 0.01 | Metallic lustre | O | No |
| 0.025 | 0.05 | Metallic lustre | O | No |
| 0.025 | 0.1 | Metallic lustre | O | No |
| 0.025 | 0.3 | Bluish gray | x | To yellow |

O means "normal", x means that some peeling of the organic lacquer coating was observed.

The undercut film corrosion test referred to in Table 1 was carried out by applying 30–40 mg/dm$^2$ of epoxy urea to the test piece, whereupon the thus coated test piece is baked at 200° C. for 10 minutes. The coating was then cut or scratched with a needle in an X pattern formation and the thus cut portion was extruded by 5 mm with an Erichsen tester. The test piece was then immersed in an aqueous solution containing 1.5% of citric acid and 1.5% of sodium chloride with the addition of a few drops of formalin per liter of solution. The immersion was effected for 5 days at 80° F.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the drawings:

FIG. 1 shows on an enlarged scale and in diagrammatic manner a cross section of an inventive steel plate coated with a chromium layer and a chromate film, while

DETAILED DESCRIPTION

Figure 1:
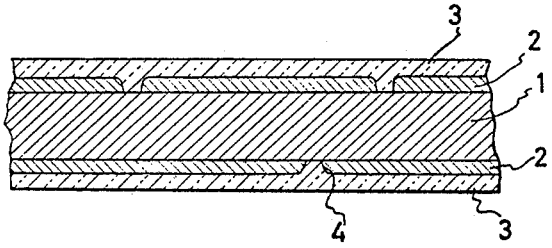

Turning now to FIG. 1, a relatively thin-gauge steel plate is indicated by reference numeral 1. A metallic chromium layer 2 is electrolytically plated onto the top and bottom surfaces of the plate, the subsequently electrolytically deposited chromate film being indicated by reference numeral 3. The chromate film 3 is firmly bonded to the chromium layer 2. It will be noted that the pin hole areas 4 are also covered by the chromate film 3.

Figure 2:
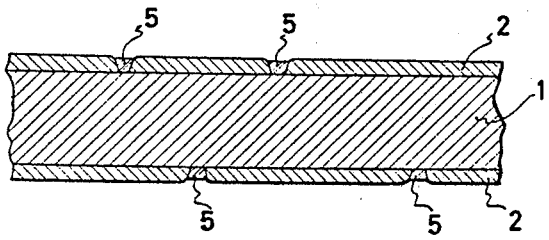
FIG. 2 shows on an enlarged scale and diagrammatically a cross section of a steel plate which has been treated in accordance with the prior art method as, for example, disclosed in U.S. Pat. No. 3,113,845.

Referring now to FIG. 2 which illustrates a prior art steel sheet, it will be noted that the metallic chromium layer 2 is directly plated onto the steel sheet 1. The dipping of the chromium plated steel sheet into a chromic acid solution merely results in the formation of a chromate layer 5 at the pin hole areas, but no chromate film is formed on the metallic chromium film 2.

The inventive chromium-chromate coated steel sheet is advantageously produced according to the following method:

The surface of the steel plate is first degreased in any conventional manner. Electrolytic degreasing is thus feasible and indeed recommended. The plate is then washed and any rust is removed by acid pickling and additional washing. The steel plate is then chromium electroplated in a first stage in a chromium plating tank to obtain a chromium coating of 0.0016–0.1 micron thickness. The thus chromium plated sheet is then washed in hot water whereupon, in a second separate stage, the chromium plated steel is subjected to an electrolytic treatment in which the chromium plated steel plate is the cathode. The electrolysis is performed in an aqueous solution containing hexavalent chromium ions such as formed by chromic acid or dichromate or containing hexavalent chromium ions mixed with trivalent chromium ions. Reducing agents or agents accelerating and inducing chromate film formation on the metallic chromium coating may be added to the bath.

Concerning the composition of the electrolytic bath for effecting the chromate film deposition, it should be noted that the bath initially may only contain hexavalent chromium ions, or trivalent chromium ions may be present in admixture with the hexavalent chromium ions. However, it should be appreciated that even if the bath initially contains hexavalent chromium ions only, trivalent chromium ions will always be produced due to the reducing action which takes place during the electrolysis. The presence of weak reducing agents, of course, further promotes the formation of trivalent chromium ions.

An important feature of the inventive procedure for forming the chromate film on the metallic chromium layer is that no sulfate ions or sulphuric acid radicals are permitted to be present in the bath which have a tendency to deposit metallic chromium on the cathode, to wit, the previously chromium coated steel sheet.

Another important feature of the inventive procedure is that the electrolytic deposition of the metallic chromium layer and the subsequent electrolytic deposition of the chromate film are carried out in two distinct and separate stages. Thus, as will be apparent from the above, the deposition of the chromium layer is carried out first and only after the chromium layer has been deposited is the thus surface treated steel sheet subjected to the electrolytic deposition of the chromate film in the absence of sulfuric acid radicals or the like catalysts which have a tendency to deposit metallic chromium.

As a general proposition, the conditions for depositing the two layers, to wit, the chromium layer and the chromate layer, may advantageously be, for example, as follows:

Conditions for formation of chromium layer.

Bath composition:

$CrO_3$: 130–170 g/liter $H_2SO_4$: 0.2–0.4 g/liter $Na_2SiF_6$: 3–7 g/liter

Bath temperature: 50°±2° C.

Current density: 20–80 amperes

Treating time: 1.25–5 seconds

Time×density=100.

Conditions for chromate film formation.

Bath composition:

$CrO_3$: 80±5 g/liter

Bath temperature: 55°±5° C.

Current density: 5 amperes

Treating time: 0.5–2 seconds

Comparative corrosion tests were carried out with three different products, to wit:

A. a steel plate on which a chromate film was directly formed in electrolytic manner;

B. a chromium plated steel plate which was dipped into chromic acid to form a chromate film; and C. a steel plate manufactured in accordance with the present invention, to wit, having an electrolytically deposited chromium coating and superimposed thereon an electrolytically formed chromate film.

The tests were conducted before the products were coated with an organic composition. The results are shown in Table 2. The results of the salt spray corrosion test referred to in the Table are stated in terms of hours up to rust formation while the results of the ferroxyl corrosion tests are given in terms of comparative values in which numeral 5 represents that substantially no rust is formed while numeral 4 represents that a few pit corrosion areas could be observed.

TABLE 2

| | | Thickness of metallic Cr. (micron) | Salt spray test hours up to rust formation | Ferroxyl test 10 min. at room temp. |
|---|---|---|---|---|
| A | Electrolytically chromate treated steel plate | 0 | 5 | 4 |
| B | Steel plate which has been chromium plated and thereafter chromate treated by dipping | 0.1 | 4 | 4 |
| | | 0.05 | 3 | 4 |
| | | 0.01 | 1 | 4 |
| C | Inventive steel plate thickness of chromate film: 0.05 mg/dm | 0.1 | 36 | 5 |
| | | 0.05 | 30 | 5 |
| | | 0.02 | 25 | 5 |
| | | 0.01 | 23 | 5 |
| | | 0.005 | 22 | 5 |
| | | 0.001 | 20 | 5 |

As is apparent from the results tabulated in Table 2, the inventive steel plate exhibits a significantly improved corrosion resistance as compared to that of the conventional surface treated steel plates, both in the salt spray test and the ferroxyl test.

As previously stated, the primary industrial application of the inventive steel plate is as can stock and since can making material is customarily lacquered or varnished by an organic coating prior to use, tests were conducted for the purpose of determining the chemical resistance of a can made from the inventive steel sheet and containing a top coat of organic material. Comparison tests with the prior art materials were also conducted. The results are tabulated in Table 3 and clearly indicate that the inventive steel plate has significantly improved characteristics as compared to those of the prior art materials.

TABLE 3

| | | |
|---|---|---|
| 1. Lacquering with organic composition | | Inside wall of can; phenol type varnish; baking at 200° C. 10 minutes; amount 35–40 mg/dm$^2$. |
| 2. Test Results | Inventive Steel Plate | Steel Plate, directly electrolytically chromate treated |
| (1) Check pattern test number of checks which do not peel amoung 100 checks | 100/100 | 100/100 |
| (2) Wood Hammer Bending Test (180°) | Normal | Some peeling of lacquer coating |
| (3) 1% Citric Acid Boiling Test (time up to pit rust formation) | 8 hrs. | 1 hrs. |
| (4) 4% Sulfuric Acid Immersion Test at room temp. (time up to pit rust formation) | 15 hrs. | 3 hrs. |
| (5) 0.4% Caustic Soda Boiling Test (time up to pit rust formation) | 35 min. | 35 min. |
| (6) 10% $CuCl_2$Immersion Test room temp. 5 min. | First | Second |
| (7) Ferroxyl Test 30 min. | First | Second |

0.025 micron chromium plating and 0.005 mg/dm$^2$chromate film

The above results are further discussed as follows:

In a prior art steel plate which is directly subjected to electrolytic chromate treatment without prior interposition of a chromium layer, the adherence between the organic lacquer coating and the chromate film is satisfactory. By contrast, however, the adherence between the chromate film and the steel surface is poor. Particularly, when immersed in citric acid and sulphuric acid, these acidic liquids penetrate through the organic lacquer film into and between the chromate film and the steel surface, thereby causing corrosion. This corrosion progresses until the organic lacquer coating peels off.

By contrast, in the inventive steel plate a metallic chromium layer is positioned underneath the chromate film and this metallic chromium layer has excellent corrosion resistance. The metallic chromium layer therefore acts as a strong protecting barrier or wall against corrosion of the steel surface proper and thus prevents corrosion even if the acidic liquid should penetrate through the lacquer coating and the chromate film. The bond or adherence between the steel surface and the metallic chromium layer is very strong and, furthermore, the adherence or bond between the metallic chromium layer and the superimposed chromate film is excellent. As a result, therefore, the metallic chromium film acts as a medium for enhancing the adherence between the chromate film and the steel surface, thus preventing penetration of acidic liquor onto the steel surface, thereby improving the total corrosion resistance of the product.

Comparative corrosion tests were also conducted in respect to cans which had been produced from the inventive steel plates and which were provided with a top coat of organic composition. Comparison tests with prior art steel plates which had been first chromium plated and thereafter chromate treated by dipping or spraying were also conducted. The results are shown in the following Table 4.

TABLE 4

| | Thickness of chromium layer (micron) | Adhesion of organic lacquer coating | Citric acid test; in 1% citric acid sol. Boiling for 5 hrs | Sulfuric acid test; in 5% $H_2SO_4$ sol. At room temp. 48 hrs. | Salt spray test, 48 hrs. at room temp. | Soy test, in soy at 75° C., 5 days | Exposure test, exposed on a roof top for 10 days (3 rainy days incl.) |
|---|---|---|---|---|---|---|---|
| Directly chromate treated steel plate | O | x | C | C | B | C | B |
| Steel Plate, chromium plated and chromate treated by dipping | 0.05 | x | A | B | A | A | B |
| | 0.03 | x | B | B | B | A | B |
| | 0.01 | x | B | B | B | A | B |
| | 0.005 | x | C | B | B | A | B |
| | 0.001 | x | D | C | C | B | C |
| Inventive steel plate having 0.05 mg/dm$^2$ chromate film under | 0.05 | x | A | B | A | A | B |
| | 0.03 | x | A | B | A | A | B |
| | 0.01 | x | A | B | A | A | B |
| | 0.005 | x | A | B | A | A | B |
| | 0.001 | x | A | B | A | A | B |
| | 0.001 | x | B | C | B | B | B |
| Electric tin plate | | y | B | C | B | B | B |

All of the test pieces were tested at a drawing rate of 5 mm (Erichsen value) after they had been coated with an organic oil varnish of 10 micron thickness. The values in Table 4 have the following meaning: A represents "no damage", B represents pit corrosion in the convex portion of the test piece; C represents peeling off over substantially the entire convex portion of the test piece; D represents corrosion over the whole surface; x indicates that no peeling of the lacquer coating took place; y means slight peeling; and B' indicates rust formation in the ring portion of the Erichsen test.

It will be noted that in a chromium plated steel plate which was subsequently chromate treated by dipping, a lowering of the corrosion resistance was still observed if the plating thickness was 0.005 micron–0.001 micron. By contrast, in the inventive steel plate the corrosion resistance is not affected down to a chromium layer thickness of 0.001. For this reason, the lower limit for the thickness of the metallic chromium layer should not be below 0.001 micron while the upper limit should not exceed 0.1 micron. As previously stated, a lower limit of 0.0016 thickness is, however, preferred from a practical and process-technical point of view. If the metallic chromium layer thickness exceeds 0.1 micron, the processing of the can stock into cans is negatively affected and inferior products are obtained.

If the metallic chromium layer has a thickness range of 0.05 to 0.1 micron, the steel plate, as is clear from Table 2, exhibits a better corrosion resistance in non-lacquered state than the steel plate corresponding to U.S. Pat. No. 3,113,845. Further, in this range, substantially similar corrosion resistance characteristics are exhibited by the inventive steel sheet in the lacquered state, to wit, a state in which the sheet is provided with a top coat of an organic composition.

In the event that the chromium layer is thicker, cracks have a tendency to appear during the manufacturing process into cans because, as is known, metallic chromium has a very significant hardness. This crack formation is counteracted in the inventive steel plate by the presence of the electrolytically deposited chromate film which covers the entire surface of the chromium layer including the pin hole portions. Since the chromate film is relatively soft, any crack formation is avoided during bending and processing in general.

The inventive steel plates can be easily processed and worked, and, as demonstrated above, have superior corrosion resistance characteristics. It therefore provides a superior material, particularly for can stock, which is produced at considerably lower cost than ordinary tin plates. A wide variety of cans and can-like products such as food cans, oil cans, detergent cans, crown caps, screw caps, etc. may be successfully manufactured from the surface-treated steel material.

It should also be noted that the inventive steel plates have remarkable characteristics in that they are not susceptible to sulphur stain. In this connection it will be appreciated that sulphur stain is a dreaded phenomenon taking place in tin plates. Since the inventive plates have better corrosion resistance in non-lacquered state than ordinary chromium plated steel sheets, the inventive steel plates can be economically produced even compared to the prior art chromium plated steels, as a thinner layer of chromium is in most cases sufficient. In addition, of course, the inventive plates have improved coating adherence and corrosion resistance, particularly if compared with prior art chromate treated steel.

According to a further feature of the invention, the inventive procedure is particularly suitable for surface treating matte finished steel sheets of the nature disclosed in U.S. patent application Ser. No. 610,025, filed Jan. 18, 1967. Thus, the inventive procedure is applicable for obtaining scratch-resistant white-silver chromium plated steel plates of the nature disclosed in said application wherein the steel plate has been matte finished. In accordance with this invention, the chromate film is then electrolytically super-imposed on the chromium film. The surface roughness of the matte finished initial steel plate may be 0.8–3 microns in terms of Hr.m.s. as disclosed in the U.S. application referred to.

The invention will now be described by an Example, it being understood, however, that this Example is being given by way of illustration and not by way of limitation and that many changes may be effected without affecting in any way the scope and spirit of the invention as recited in the appended claims.

EXAMPLE

1. Pretreatment

A cold rolled steel sheet of 0.27 mm thickness is subjected to electrolytic degreasing in a 5% caustic soda solution at 90° C. and at a current density of 20 A/dm$^2$. The electrolytic degreasing treatment is carried out for 2 seconds, whereupon the sheet is washed. The sheet is then subjected to acid pickling in a 10% sulphuric acid solution for 2 seconds whereupon further washing is effected.

2. Chromium plating

The thus cleaned steel sheet is then employed as the cathode in an electrolytic circuit, the electrolytic bath containing 200 g/l of chromic acid and 20 g/l of sulphuric acid. The electroplating is carried out at 50° C. and with a current density of 40 A/dm$^2$ for 1 second.

3. Chromate layer formation

After washing, the chromium plated sheet is employed as the cathode in an electrolytic circuit, the electrolytic bath being a chromate treating liquor containing 50 g/l of chromic acid and 2 g/l of sodium silicofluoride. The temperature of the bath was 40° C. and the chromate deposition was effected under a current density of 5 A/dm$^2$ for 2 seconds. The thus electroplated sheet was then washed, dried and oiled.

4. Organic coating

The inventive steel sheet may be lacquered or varnished with an organic coating composition which may, for example, be phenol based, oil based, alkyd-based, vinyl resin based or epon or epoxy based. Varnishes and lacquers as disclosed, for example, in U.S. Pat. No. 3,113,845 may be used. It will be appreciated that generally any suitable coating composition used as top layer in cans may be employed for the inventive purposes, the various coating compositions being used either singly or in combination.

Synthetic resin coatings of the vinyl type, phenol type and polyethylene type may be used as lacquers with or without adhesives.

Recently, a one-step procedure has been proposed according to which a steel sheet is cathodially plated in an aqueous bath of chromic anhydride containing trivalent chromium ions and a sulphuric acid radical in specific amount. It is alleged that this procedure results in the formation of an intermediate metallic chromium layer and a non-metallic chromate top layer. This procedure has been disclosed in U.S. Pat. No. 3,296,100. Since from a practical point of view it is at the present state of analytical knowledge not possible to distinguish between a metallic chromium layer and a superimposed chromate layer, if the layers are extremely thin, the alleged result cannot be confirmed or verified and is, in fact, questionable. In any event, the present procedure is quite different from that disclosed in U.S. Pat. No. 3,296,100.

As the composition of the treating liquids and the process conditions are different and in accordance with the present procedure, the chromium layer and the chromate film are applied in two separate steps while according to the process referred to both layers are allegedly formed in the same step, different results are obtained. Moreover, according to U.S. Pat. No. 3,296,100, the treating solution contains a sulphuric acid radical while according to the present procedure the chromate treatment must be effected in the absence of such radicals in order to avoid the deposition of metallic chromium.

As set forth, it is presently not possible to identify the chemical composition of the layers allegedly formed according to U.S. Pat. No. 3,296,100 since these layers are extremely thin and amorphous. However, since the bath compositions are different, it must be reasonably assumed that the chemical composition of the layers in the U.S. patent referred to and in the present steel sheet are distinct. In order to investigate this difference, tests have been performed which are reported as follows:

Test pieces produced according to the U.S. patent and according to the inventive procedure were immersed in various solutions and the amount of dissolved chromium was determined. The area of the test pieces was 3 dm$^2$. The results are shown in the following table in terms of ppm of dissolved chromium when immersed in 300 ml of solution for 24 hours at a temperature of 50° C.

TABLE 5

| Immersion solution | Steel plate as Surface Treated by Present Invention | Steel Plate Surface Treated according to U.S. Pat. No. 3,296,100 |
|---|---|---|
| Ion Exchange water | Tr. | 0.37 |
| 3% $Na_2CO_3$ | Tr. | 0.71 |
| 3% NaCl | Tr. | 0.15 |
| 50% Ethyl Alcohol | Tr. | 0.60 |

Tr. represents <0.01 ppm.

The significant differences in the amount of dissolved chromium as appearing in Table 5 indicate that there is an essential difference in the chemical composition of the top layers.

In this connection it should again be emphasized that the thickness of the chromate film as disclosed herein is critical and that the thickness of this film according to the present procedure is considerably greater than that of the U.S. patent. As is clear from the figure of the U.S. patent, when both a metallic chromium layer and a chromate top layer are simultaneously formed in a one-step procedure, as alleged in the U.S. patent, the thickness of the metallic chromium layer must have a certain ratio in respect to that of the chromate film. This ratio is 2 mg/dm$^2$ (0.0275 micron to 1.8 mg/dm$^2$). Although this ratio may vary slightly, it is not possible to produce a surface treated steel plate having a thickness ratio which is essentially different from the indicated ratio. Based on this ratio, if the thickness of the top layer is less than 0.1 mg/dm$^2$, the thickness of the metallic chromium layer is always less than 0.0015 micron.

Since the process of the present invention is a two-step process, it is thus feasible to apply a thicker metallic chromium layer (0.0016–0.1 micron) and a thinner top layer (0.1 mg/dm$^2$ Cr). Experiments have indicated that in the present procedure the best results are obtained if the electrolytic chromate deposition is carried out for 0.5–2 seconds only. Longer periods than 2 seconds should be avoided.

While a specific embodiment of the invention has been shown and described in detail to illustrate the application of the inventive principles, it will be understood that the invention may be embodied otherwise without departing from such principles.

What is claimed is:

1. A process of forming a chromate film on a chromium plated steel sheet for use in can making, the chromium layer on the steel sheet having a thickness not exceeding about 0.1 micron, which comprises placing the chromium plated steel plate as a cathode into an electroplating bath consisting essentially of about 50 g/liter of chromic acid and about 2 g/liter of sodium silico-fluoride as a reducing agent and containing no sulfuric acid radicals and continuing the electrolysis until a chromate film having a thickness not exceeding 0.1 mg/dm$^2$ has been formed on the chromium layer, said electrolysis being carried out at a bath temperature of about 40° C., a current density of 5 amperes per dm$^2$ and for a treating time of about 2 seconds, said thus coated steel sheet possessing excellent corrosion resistance, adhesion for organic coatings and said film being resistant to deterioration on bending.

* * * * *